US006408987B2

(12) United States Patent
Morishita

(10) Patent No.: US 6,408,987 B2
(45) Date of Patent: Jun. 25, 2002

(54) ELEVATOR GUIDANCE DEVICE

(75) Inventor: Mimpei Morishita, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/812,787

(22) Filed: Mar. 15, 2001

(30) Foreign Application Priority Data

Mar. 16, 2000 (JP) ..... 2000-073406

(51) Int. Cl.[7] ..... B66B 1/34
(52) U.S. Cl. ..... 187/292; 187/393; 187/409
(58) Field of Search ..... 187/293, 391–394, 187/409; 361/143, 144, 146, 152, 154

(56) References Cited

U.S. PATENT DOCUMENTS

| | | | | |
|---|---|---|---|---|
| 5,027,925 A | * | 7/1991 | Kahkipuro | 187/115 |
| 5,477,788 A | | 12/1995 | Morishita | |
| 5,749,444 A | * | 5/1998 | Skalski | 187/409 |
| 5,814,774 A | * | 9/1998 | Remmers et al. | 187/292 |
| 5,866,861 A | * | 2/1999 | Rajamani et al. | 187/292 |
| 6,338,396 B1 | * | 1/2002 | Morishita | 187/292 |

FOREIGN PATENT DOCUMENTS

| | | | |
|---|---|---|---|
| JP | 354051161 A * | 4/1979 | 187/292 |
| JP | 7-187552 | 7/1995 | |
| JP | 10-114482 | 5/1998 | |

OTHER PUBLICATIONS

Copy of U.S. patent application Ser. No. 09/612,179, filed Jul. 6, 2000, to Morishita.

* cited by examiner

*Primary Examiner*—Jonathan Salata
(74) *Attorney, Agent, or Firm*—Finnegan, Henderson, Farabow, Garrett & Dunner, L.L.P.

(57) ABSTRACT

A moveable body (16) is guided in non-contacting fashion by exercising control by a guidance control unit (C1) constituted by zero power-control means (unit) (L2) and stabilization unit (L1) of a magnetic levitation system (C2) comprising guide rails (14) and (14') and magnetic units (30) mounted on the moveable body (16); also there is provided output limiting unit (C3) whose output value is limited based on the output value of the zero power control means (unit) (L2) itself. Improvement in the comfort of the ride is thereby achieved by expanding the allowed range of external force under which non-contacting guidance can be achieved. Also, increase in size of the magnetic units or reduction in the width of the designed gap length in order to cope with external force is thereby avoided, lowering the costs of the elevator system and enabling reliability to be improved with diminished frequency of contact with the guide rails.

9 Claims, 14 Drawing Sheets

ELEVATOR GUIDANCE DEVICE

BACKGROUND OF THE INVENTION

1. Field of the Invention

The present invention relates to an elevator guidance device that actively guides a moving body such as an elevator cage.

2. Description of the Related Art

An elevator comprises a guide rail arranged in an elevator shaft, an elevator cage that is suspended by a wire, and raising/lowering means (unit) that raise/lower the cage by applying tension to the wire. Since the cage is suspended by the wire, it swings due to imbalances of the load weight or movement of the passengers; however, such swinging is suppressed by its being guided on the guide rails and it therefore ascends/descends along the guide rails. For guidance of the cage, conventionally, a guidance device comprising vehicle wheels in contact with the guide rails and a suspension was employed, however, vibration and noise caused by distortions or joints of the guide rail was transmitted through the vehicle wheels to the passengers and so was a factor impairing the comfort of the elevator. In order to solve this problem, various systems (for example, Laid-open Japanese Patent Publication number Sho. 51-116548, and Laid-open Japanese Patent Publication number H. 06-336383 and the like) have been proposed involving mounting an electromagnet on the elevator cage and guiding the cage in non-contacting manner by having the attractive force of the electromagnet act on an iron guide rail. Of these, Japanese Patent application H. 11-192224 discloses an elevator guide device wherein, in magnetic units comprising an electromagnet constituted by arranging the poles of an electromagnet opposite each other with guide rails in between and facing the guide rails through a gap and a permanent magnet arranged so as to share its magnetic path with the electromagnet in the aforesaid space, guidance control is exercised whereby the attractive forces of these magnetic units that act on the guide rails are stabilized while making the exciting current of the electromagnets converge to zero. By means of this technique, an elevator of low cost can be realized in which a comfortable ride can be provided and installation costs such as those of mounting the guide rails are controlled. However, even in such a case, the following problems arise.

Specifically, when elevator cage guidance control is performed whilst making the electromagnet exciting current of the magnetic units converge to zero, the gap lengths between the magnetic units and the guide rails such that external forces acting on the elevator cage and external disturbance torque due to these are as well as the permanent magnet attractive force of the magnetic units are exactly in balance change. That is, when external force acts on the elevator cage, the gap lengths change such as to oppose the application of the external force. Accordingly, if for some reason excessive external force acts on the elevator cage, the cage moves in the opposite direction to the direction of action of the external force, ultimately causing the magnetic units to contact the guide rails. When the magnetic units contact the guide rails, further external force is applied due to reaction from the guide rails, causing further change of the attractive force of the magnetic units in the guidance control device in the opposite direction to this external force, with the result that further change of the gap length is promoted. Thus, once the magnetic unit contacts the guide rail, guidance control acts such that those gap lengths which had become shorter on contact become even shorter and those gap lengths that had become wider become even wider, with the result that ultimately the elevator cage is completely in contact with the guide rail without any possibility of returning once more to a non-contacting condition.

Even in such a case, for example as disclosed in published Japanese Patent Number H. 06-24405, the phenomenon of adhesion of the elevator cage to the guide rail due to external force can be avoided if the guidance control means (unit) is provided with the function of actuating power control means (unit) having the function of making the electromagnet exciting current converge to zero when the gap length is in a prescribed range. Specifically, the zero power function whereby the electromagnet exciting current is made converge to zero by the guidance control device can be disabled by setting the output of the zero power control means (unit) as in the embodiment of this publication such that it is changed over to zero by setting the operating range of the zero power control means (unit) to be just before contact of the electromagnetic units with the guide rails. Since the attractive force of the magnetic units is controlled so as to return to the set gap length in respect of the external force when operation of the zero power control means (unit) is disabled, it becomes possible for the elevator cage to be again restored to the non-contacting condition by change of the gap length, which had changed so as to oppose the external force, in the direction of application of the external force. However, even in this case, action of the guidance control device of the elevator cage is unsatisfactory. In Published Japanese Patent Number H. 06-24405, magnetic levitation control as described above is applied to a levitation type carrier device. With the chief purpose of completely avoiding contact of the magnetic units and the guide rail in order to prevent generation of dust, in a running carrier vehicle, the gap length is rapidly increased by disabling the zero power control means (unit) in order to avoid contact with the guide rail produced by transient external force applied to the carrier vehicle on for example passage of a step in the guide rail. Consequently, if the gap length is increased by disabling of the zero power control, operation of the zero power control means (unit) is recovered in cases where the external force is not transient, for example cases where the rated carrying weight is exceeded. If this happens, the phenomenon of recovery occurs, in which the zero power control is again disabled by decrease of the gap length. However, even in this case, contact of the carrier vehicle with the guide rail is avoided and the objective of preventing generation of dust is achieved. However, in the case of an elevator, priority is given to a comfortable ride rather than to prevention of generation of dust. Thus, if enabling/disabling of the zero power control means (unit) is determined on the basis of the range of the gap length, if an excessive but steady external force is applied to the elevator cage, continuous fluctuation of the gap length occurs as described above, severely impairing comfort.

In order to solve these problems, it is necessary to make the dimensions of the magnetic units large and to set the gap lengths to a small value beforehand at the design stage, so as to maintain balance with external force by means (unit) of a large change of attractive force for even slight variations of gap length in response to external force, by making the variation of attractive force of the permanent magnet with respect to variation of the gap length large. However, with such measures for solution of the problem, the magnetic units become large in size and high precision is required in the installation of the guide rails, leading, as a result, to the problem of increased costs.

Thus, with the conventional elevator guidance device, there was the problem that since enabling/disabling of the zero power control means (unit) was determined by the gap length between the magnetic units and the guide rails, if an external force of a certain level of magnitude was applied to the elevator cage, the comfort of the ride was severely impaired. Furthermore, if, in order to avoid such problems, the magnetic units were increased in size, the device became of large size; on the other hand, if the designed gap length was set to a small value, installation of the guide rails had to be carried out with great precision, in either case, this made the elevator system complicated and/or large in size, and resulted in high costs.

SUMMARY OF THE INVENTION

Accordingly, one object of the present invention is to provide a novel elevator guidance device wherein, in addition to improved comfort, simplification and/or size reduction, lower costs and improved reliability of the device can be achieved.

In order to achieve the above object, an elevator guidance device according to the present invention is constructed as follows. Specifically, it comprises: a guide rail installed in the vertical direction; a moveable body capable of being raised and lowered along the guide rail; electromagnets mounted on the moveable body and comprising magnetic poles that face the guide rails with a gap therebetween and which are arranged so that the attractive forces that act on the guide rails at at least two of the magnetic poles of these magnetic poles are in mutually opposite directions; magnetic units comprising a permanent magnet that supplies magnetomotive force needed for guidance of the moveable body and that is arranged so as to share its magnetic path in the gap with the electromagnets; sensors that detect the condition in the gap of the magnetic circuit formed by the electromagnets with the gap and the guide rail; guidance control means (unit) that control the exciting current of the electromagnets in accordance with the output of these sensors and thereby stabilize the magnetic circuits; zero power control means (unit) that stabilize the magnetic circuits in a condition wherein the exciting current of the electromagnets is zero, based on the output of the sensors; and output limiting means (unit) that set a prescribed saturation value for the output of the zero power control means (unit) and if the output of the zero power control means (unit) exceeds the range defined by this saturation value, make this saturation value the output of the zero power control means (unit).

Also, a zero power control means (unit) may be selected that comprises an integrator that integrates deviations of the exciting current from a prescribed value, with a prescribed gain. Furthermore, a zero power control means (unit) may be selected that comprises a state monitoring device that monitors the external force that is applied to the magnetic guidance system from the output value of the sensors and a gain compensator that multiplies by a prescribed gain the inferred value of the external force monitored by this state monitoring device. In addition, a zero power control means (unit) may be selected that comprises at least a first-order delay filter that inputs the output of the sensors. Also, an output limiting means (unit) may be selected that has the function that, if the output value of the zero power control means (unit) is outside the range specified by the prescribed maximum saturation value and minimum saturation value, if the output value of the zero power control means (unit) is larger than the maximum saturation value, outputs the maximum saturation value and if it is smaller outputs the minimum saturation value and if it is within the range outputs the output value of the zero power control means (unit) unchanged.

Furthermore, an output limiting means (unit) may be selected that comprises a Zener diode arranged with the output terminal of the zero power control means (unit) in the forward direction from the output terminal of a constant-voltage source that defines the maximum saturation value.

In addition, an output limiting means (unit) may be selected that comprises a Zener diode arranged with the output terminal of a constant-voltage source that defines the minimum saturation value in the forward direction from the output terminal of the zero power control means (unit).

Also, an output limiting means (unit) may be selected that comprises a first Zener diode arranged with the output terminal of the zero power control means (unit) in the forward direction from the output terminal of a constant-voltage source that defines the maximum saturation value and a second Zener diode arranged with the output terminal of a constant-voltage source that defines the minimum saturation value in the forward direction from the output terminal of the zero power control means (unit).

Furthermore, an output limiting means (unit) may be selected that comprises an operational amplifier whose positive side power source is a fixed voltage source that defines the maximum saturation value and whose negative side power source is a fixed voltage source that defines the minimum saturation value.

According to the present invention, an elevator cage is guided magnetically in non-contacting fashion by means of magnetic units comprising electromagnets, with respect to an iron guide rail arranged in the vertical direction. The magnetic units comprise permanent magnets that share a magnetic path in the gap between the guide rails and the electromagnets. Guidance of the elevator cage is effected by, if the cage swings for some reason, detecting this swing and changing the electromagnet exciting currents in accordance with the swing, so as to cause attractive force of the magnetic units to act on the guide rail. Swinging of the cage changes the magnetic resistance of the magnetic path due to change of the gap length between the guide rails and the magnetic units, and the electromagnet exciting current provokes variation of the magnetomotive force of the magnetic circuits. Consequently, in the cage guidance control, the gap lengths or exciting currents are detected and the electromagnets are excited with a current or voltage calculated from these values. In these circumstances, when the zero power control means (unit) is operating, in the steady condition, the exciting currents of the electromagnets converge to zero and the gap lengths of the magnet units are changed so that the attractive forces produced by the permanent magnets of the plurality of magnet units mounted on the elevator cage are mutually in balance and non-contacting guidance is achieved. When in this condition external force acts on the elevator cage, swinging of the cage is produced, but the electromagnets are excited so as to suppress this swinging. By action of the zero power control means (unit), the gap length between the magnet units and the guide rails is changed by attractive force produced by the excitation of the electromagnets with the result that ultimately the exciting currents converge to zero at a gap length such that the attractive force of the permanent magnets and the external force are in balance, causing the swinging of the elevator cage to be arrested. Consequently, when the external force and the attractive force of the permanent magnets are in balance, the gap length of the magnetic poles that generate attractive force opposing the external force becomes narrower, and contrariwise the gap length of the magnetic poles that generate attractive force in the same direction as the external force is increased. An elevator guidance device using such zero power control is described in detail in Published Japanese Patent No. H. 06-24405, so a detailed description of the operation of the zero power control means (unit) is here omitted.

Once the magnet units come into contact with the guide rails due to application of a large external force when the zero power control means (unit) is operating, the electromagnets are excited in such a way as to increase the degree of contact, so it is impossible for the elevator cage to return again to the non-contacting condition. Consequently, in the present invention, there is provided output limiting means (unit) that limits the output of the zero power control means (unit) in accordance with its own output value. If excessive external force is applied during operation of the zero power control means (unit), the output of the zero power control means (unit) increases, trying to reach a gap length at which a permanent magnet attractive force overcoming this would be obtained. If this happens, when the output of the zero power control means (unit) is saturated, the function of the zero power control means (unit) is disabled at this time point. When the zero power control means (unit) is in operation, the guidance control means (unit) performs guidance control such that the gap length becomes a value obtained by adding the gap length deviation based on the output value of the zero power control means (unit) to the set value of the gap length, which is set to a prescribed value; however, when the output of the zero power control means (unit) saturates due to the output limiting means (unit), a shift takes place to guidance control targeting the gap length at this time point. Consequently, the gap length that had increased (decreased) in response to external force when the zero power control means (unit) was operating is decreased (increased) in response to the external force when operation is disabled. When, under guidance control by the guidance control means (unit), the gap length decreases (increases) in response to the magnitude of the external force, the sensor detects the change of this magnetic circuit and the electromagnet is excited, causing the attractive force of the magnet unit to increase, whilst the gap length diminishes (increases), with the result that convergence of the change of the gap length takes place, with the attractive force of the magnet unit balancing the external force. Then, when the external force is removed, the gap length tries to return to the value which it had when the operation of the zero power control means (unit) was disabled, by the action of the guidance control means (unit); however, since, at this time point, the external force has already been removed, the input to the zero power control means (unit) acts so as to decrease this output, with the result that this output value is now less than the saturation value, and the zero power control means (unit) again shifts to operating condition. When the zero power control means (unit) again returns to its operating condition, zero power control of the elevator cage is again performed making the gap lengths of the magnet units converge to a width at which the attractive forces of the respective permanent magnets are in balance.

In this way, according to the present invention, thanks to the limitation of the output of the zero power control means (unit) based on its own output value, even though the gap length varies in response to external force, the variation of the output value of the zero power control means (unit) in the vicinity of the control value (saturation value) is continuous and smooth, so vibration of the elevator cage produced by actuation/disabling of the zero power control means (unit) can be avoided. As a result, a comfortable ride can always be obtained. Also, even if excessive external force results in disabling of the operation of the zero power control means (unit) and contacting of the magnet units with the guide rails, at this time point, by the guidance control means (unit), the electromagnets are excited in such a way as to prevent contact, so that, when this external force is removed, the elevator cage can be again restored to a non-contacting condition. Consequently, there is no possibility of the magnet units becoming stuck to the guide rail and an elevator guidance device of high reliability can thus be provided. Furthermore, there is no need to make the magnet units of large size or to make the design values of the gap lengths small as counter-measures to deal with application of external force, so the costs of the elevator system can be lowered.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
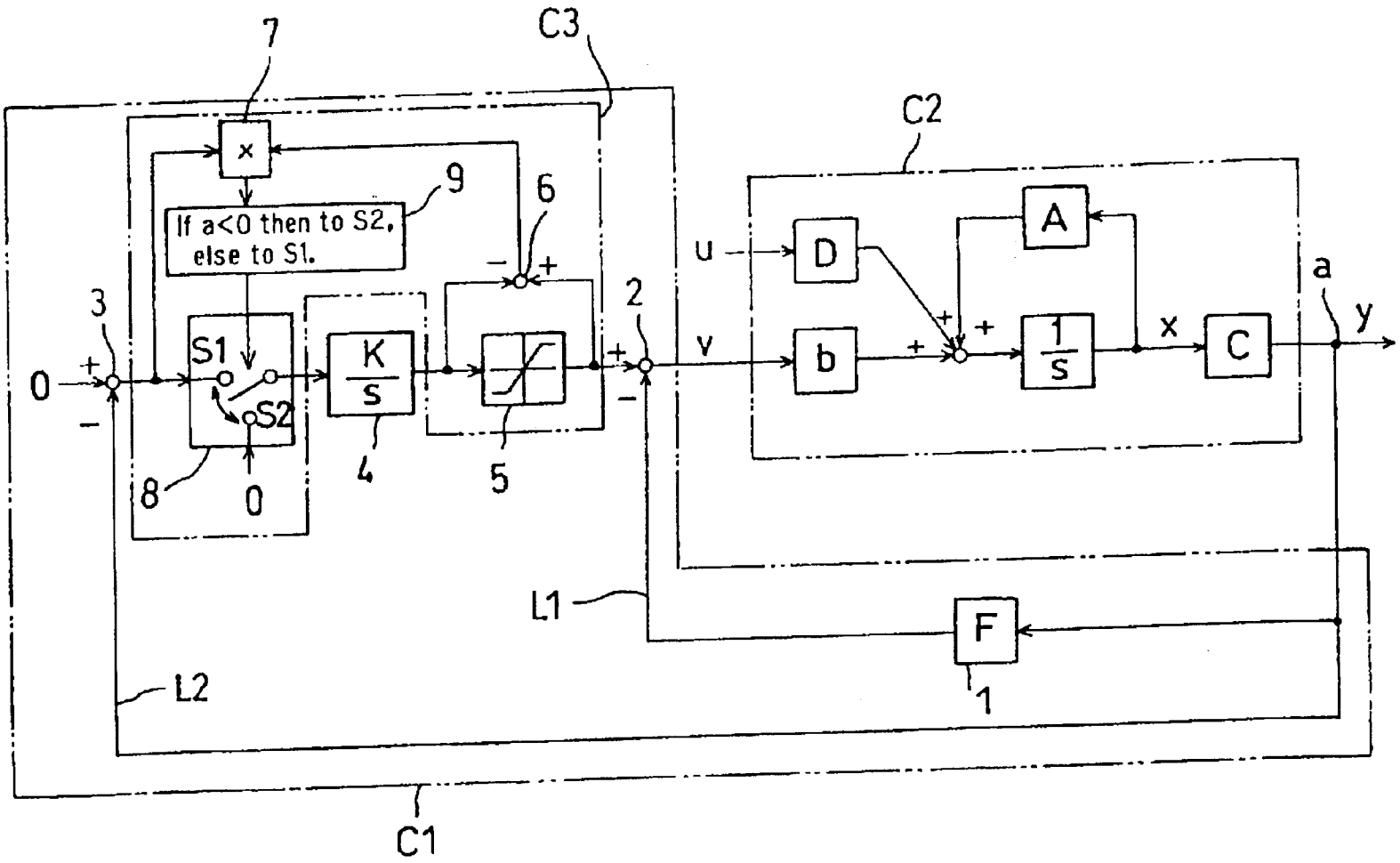
FIG. 1 is a block diagram illustrating the overall construction of a first embodiment of the present invention.

Referring now to the drawings, wherein like reference numerals designate identical or corresponding parts throughout the several views, and more particularly to FIG. 1 thereof, one embodiment of the present invention will be described.

In FIG. 1, the major parts of a magnetic levitation system C2 according to a first embodiment of an elevator guidance device when guidance control means (unit) C1 and the elevator cage are guided in non-contacting fashion are illustrated in the form of a control block diagram. In the Figure, A, b, C, and D are respectively a system matrix, input matrix, output matrix and external disturbance matrix of this magnetic levitation system; x is a state vector of the magnetic levitation system, u is external force, and y is a state variable detected by a sensor. s represents a Laplace operator.

As shown in FIG. 1, guidance control means (unit) C1 comprises stabilizing control means (unit) L1 comprising point a to gain compensator 1 to subtractor 2, zero power control means (unit) L2 comprising point a to subtractor 3 to integrating compensator 4 to subtractor 2, and output limiting means (unit) C3 that limits the output of zero power control means (unit) L2 to a prescribed range. In zero power control means (unit) L2, subtractor 3 compares zero and the electromagnet exciting current value, and inputs the result to integrating compensator 4. Also, output control means (unit) C3 comprises: saturator 5 that, if the input value does not exceed a prescribed maximum value and minimum value outputs its input without modification but if the input value exceeds this maximum value outputs the maximum value and if it is less than the minimum value outputs the minimum value; a subtractor 6 that subtracts its input signal from the output signal of saturator 5; a multiplier 7 that multipliers the output of subtractor 6 and the output of subtractor 3; a switch 8 wherein contact S1 is connected to the output of subtractor 3 and a contact S2 is connected to the zero signal; and drive means (unit) 9 that, if the output of multiplier 7 is non-negative, drives switch 8 to contact S1 and if it is negative drives switch 8 to S2.

If therefore the magnetic levitation control system constituted by magnetic levitation system C2 and guidance control means (unit) C1 is stable, the input to integrating compensator 4 must be zero; as a result, non-contacting guidance control using magnetic levitation in a condition in which the electromagnet exciting current is zero is achieved. If now we assume that the output of integrating compensator 4 is between the maximum value and minimum value of saturator 5, the input and output of saturator 5 are the same, so zero will be output from subtractor 6. Multiplier 7 will therefore output zero irrespective of the output value of subtractor 3. When zero is output from multiplier 7, drive means (unit) 9 selects contact S1 of switch 8. When this happens, the zero power control loop: point a to subtractor 3 to integrating compensator 4 to subtractor 2 is completed, causing the zero power control means (unit) L2 to be actuated, thereby achieving zero power control. On the other hand, if external force is applied to the elevator cage, due to the action of stabilizing means (unit) L1 and zero power control means (unit) L2, electromagnet exciting current transiently flows in the magnetic units, and the gap length between the magnetic units and the guide rails changes so as to aim to achieve balance with the external force by the permanent magnet attractive force with convergence of the exciting current to zero. This fluctuation of the gap lengths is detected by sensors, and multiplied by a prescribed gain in stabilization means (unit) L1 before being output to subtractor 2. At this point, under the zero power control, the output of zero power control means (unit) L2 cancels the output value of the stabilization means (unit) L1, with the result that the exciting voltage or exciting current of the electromagnets becomes zero. Consequently, when variation of the gap length occurs due to external force, the output of zero power control means (unit) L2 is also varied in accordance with the output variation of stabilization means (unit) L1. If we assume that the output of the stabilization means (unit) L1 immediately before contact of the magnetic unit with the guide rail due to external force is the maximum value (minimum value) of saturator 5 and the output value of stabilization control means (unit) L1 when external force is applied of the same magnitude but in the opposite direction is the minimum value (maximum value) thereof, when external force in excess of this external force is applied, operation of the zero power control means (unit) is disabled as follows. That is, when, with variation of the output of the stabilization means (unit) L1, the output of the zero power control means (unit) L2 varies, causing the output value of the integrating compensator 4 to exceed the maximum value (minimum value) of saturator 5, subtractor 6 outputs a negative (positive) calculation result. At this point, if the output of subtractor 3 is a positive (negative) value that further increases (reduces) the output value of integrating compensator 4, multiplier 6 outputs a negative value. As a result, in switch 8 contact S2 is selected, zero is input to integrating compensator 4, and the integration operation is disabled. Thus the output of integrating compensator 4 is fixed at the saturation value of saturator 5, causing the action of zero power control means (unit) L2 to be disabled. At this point, stabilization means (unit) L1 continues to operate, and the guidance control of the elevator cage shifts to the conventional gap length control with a target value of the gap length at saturation. In this situation, the electromagnet exciting current is of course increased/decreased with respect to the applied external force so that this external force and the attractive force of the magnetic units are in balance. Of course, when the external force that was applied is removed, by the action of the stabilization means (unit) L1, the gap length starts to shift to the value that it had when the operation of the zero power control means (unit) L2 was disabled. Meanwhile, the magnitude of the electromagnet exciting current that was supplied is reduced to zero so that the magnetic unit attractive force balances the external force. In this process, the gap length changes in the vicinity of the value where operation of the zero power control means (unit) L2 was disabled but, since the external force is already removed, at the gap length at this time point, the permanent magnet attractive force there was hitherto balanced with the external force is now excessive. When this happens, the attractive force of the entire magnetic units returns to its value prior to application of external force, so the electromagnets are excited by the action of stabilization means (unit) L1 by a current in the opposite direction to that when they were in balance with the external force; this exciting current flowing in the opposite direction is input to subtractor 3, with the result that the output of multiplier 7 changes from its previous negative to positive. When this happens, contact S1 of switch 8 is selected, causing the output signal of subtractor 3 to be fed once more to integrating compensator 4; however, in this case, the output of subtractor 3 is a value having the opposite sign to the value that it had when external force was applied, so the magnitude of the output of integrating compensator 4 is reduced. When this occurs, the output of saturator 5 changes from its saturated value to a value which is the same as the output value of integrating compensator 4, so the operation of zero power control means (unit) L2 is restored. When the operation of the zero power control means (unit) L2 is restored, the output of subtractor 6 becomes zero, and operation of the zero power control means (unit) L2 is continued until the output value of integrating comparator 4 again becomes the limiting value of output limiting means (unit) C3.

Figure 2:
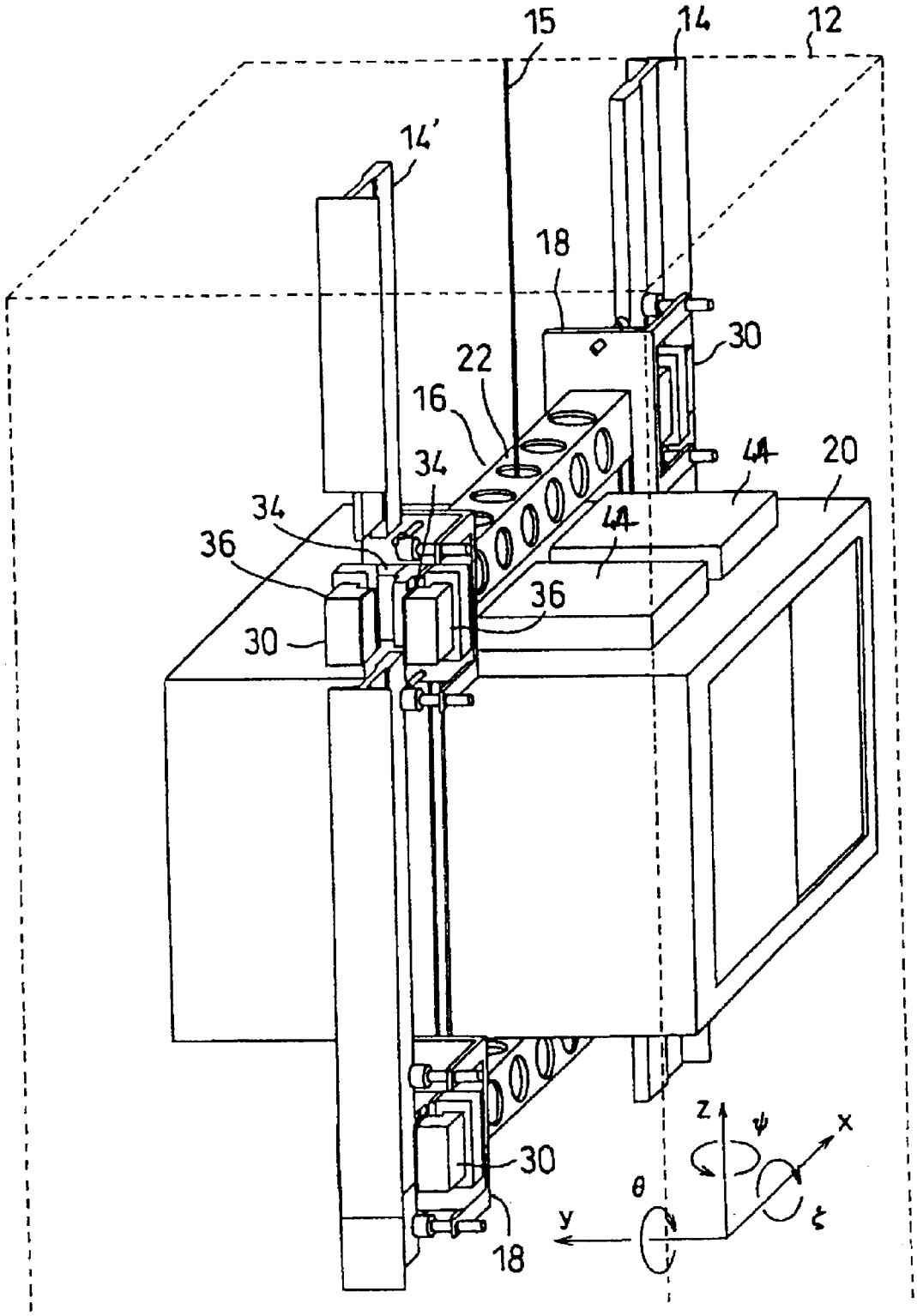
FIG. 2 is a perspective view illustrating the overall construction of the first embodiment.
Figure 3:
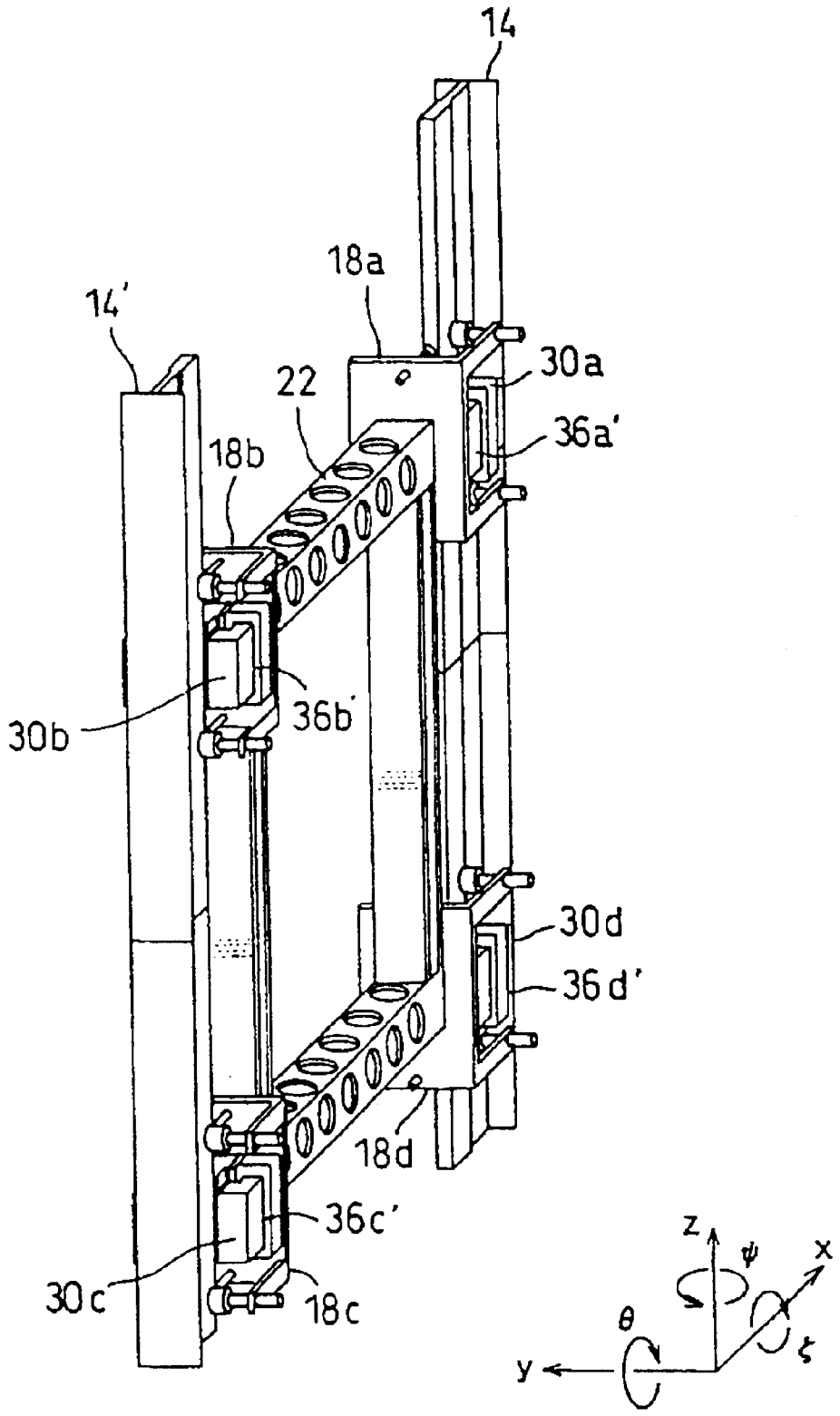
FIG. 3 is a perspective view illustrating the relationship between a moveable body and a guide rail according to the first embodiment.
Figure 4:
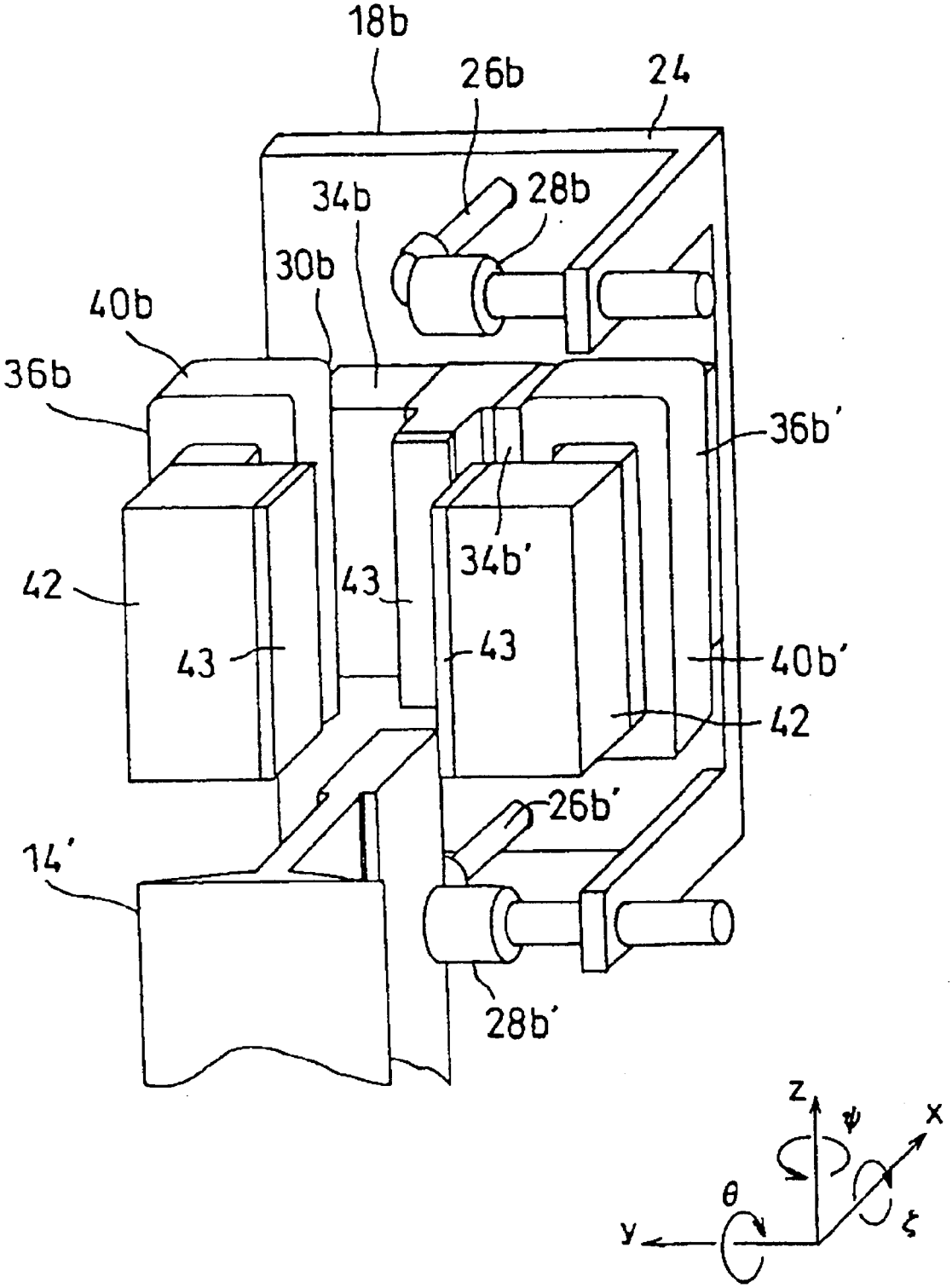
FIG. 4 is a perspective view illustrating the construction of a magnetic unit according to the first embodiment.

FIG. 2 to FIG. 5 illustrate the layout of a first embodiment of the elevator guidance device relating to the guidance control means (unit) of FIG. 1. As shown in FIG. 2, this device comprises ferromagnetic guide rails 14 and 14' installed by a prescribed mounting method on the inside surface of an elevator shaft 12, a moveable body 16 that is moved vertically by drive means (unit), not shown, such as for example winding of a rope 15, along these guide rails 14 and 14', and four guide units 18*a* to 18*d* mounted on moveable body 16 and that guide the moveable body in non-contacting fashion with respect to guide rails 14 and 14'. Moveable body 16 comprises a cage 24 carrying people and load, and a frame 22 on which are mounted cage 20 and guide units 18*a* to 18*d* and having sufficient strength to maintain the positional relationship of guide units 18*a* to 18*d,* these guide units 18*a* to 18*d* being mounted by a prescribed method facing guide rails 14 and 14' at the four corners of frame 22. Guide units 18 are constituted by mounting by a prescribed method on a base 24 of non-magnetic material such as for example aluminum or stainless-steel or plastics x-direction gap sensors 26 (26*b* and 26*b*'), y-direction gap sensors 28 (28*b* and 28*b*') and magnetic units 30. Magnetic units 30 are constituted by a central iron core 32, permanent magnets 34 and 34', and electromagnets 36 and 36', these being the assembled as a whole in E configuration in condition such that similar poles of permanent magnets 34 and 34' face each other with a central iron core 32 therebetween. Electromagnets 36 and 36' are constituted by inserting L-shaped iron cores 38 (38') into coils 40 (40'), then mounting flat plate-shaped iron cores 42 at the tip of iron cores 38 (38'). At the tips of central cores 32 and electromagnets 36 and 36', there are mounted solid-state lubricating members 43 such as to prevent adhesion and sticking of magnetic units 30 to guide rails 14 (14') by the attractive force of permanent magnets 34 and 34' when electromagnets 36 and 36' are not excited, and to prevent raising/lowering of moveable body 16 being obstructed, even in the adhering condition. Solid-state lubricating members include materials containing for example Teflon (trade name) or graphite or molybdenum disulphide etc. Hereinbelow, for simplicity, the description will be given with letters of the alphabet, as guide units 18*a* to 18*d*, appended to the numerals indicating the major parts.

In magnetic unit 30*b*, the attractive force acting on guide rail 14' can be separately controlled in respect of the y-direction and x-direction by separately exciting coils 40*b* and 40*b*'. Details of this control system are disclosed in Japanese Patent Application Number H. 11-192224, so a detailed description thereof is omitted.

The attractive forces of guide units 18*a* to 18*d* are controlled by control device 44, so that cage 20 and frame 22 are guided in non-contacting fashion with respect to guide rails 14 and 14'.

Figure 6:
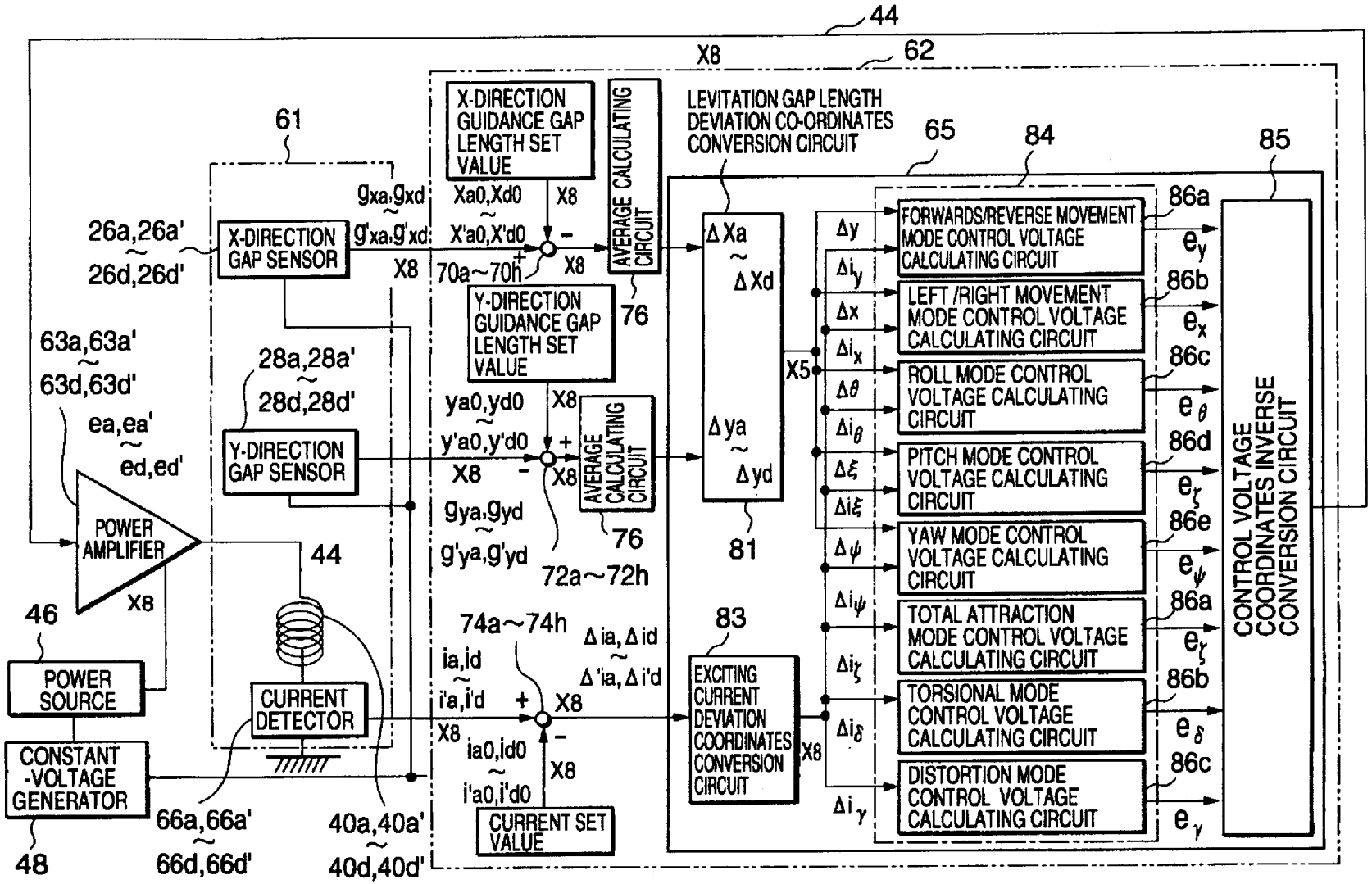
FIG. 6 is a block diagram illustrating the circuit layout of a control device according to the first embodiment.

Although control device 44 is divided as shown in FIG. 1, it could for example be constituted as a single whole as shown in FIG. 6. In the block diagram below, the arrows indicate the signal path and the solid lines indicate the power path in the vicinity of coil 40. This control device 44 comprises: sensors 61 that detect the magnetomotive force in the magnetic circuit formed by magnetic units 30*a* to 30*d* mounted on cage 20 or changes of magnetic resistance or the motion of moveable body 16; calculating circuit 62 that calculates the voltages to be applied to coils 40*a*, 40*a*' to 40*d,* 40*d*' such that moveable body 16 is guided in non-contacting fashion based on the signal from these sensors 61; and power amplifiers 63*a*, 63*a*' to 63*d,* 63*d*' that supply power to the coils 40 based on the output of calculating circuit 62; the attractive forces of the four magnetic units 30*a* to 30*d* are independently controlled by these in the x-direction and y-direction.

At the same time as it supplies power to power amplifiers 63*a*, 63*a*' to 63*d,* and 63*d*', power source 46 also supplies power to a constant-voltage generating device 48 that supplies power at fixed voltage to calculating circuit 62 and gap sensors 26*a*, 26*a*' to 26*d,* 26*d*', 28*a,* 28*a*' to 28*d*, 28*d*'. This power source 46 supplies power to a power amplifier and so has the function of converting AC supplied from outside elevator shaft 12 into DC suitable for power supply to a power amplifier by means of power cables, not shown, for illumination and/or door opening/closing.

Constant-voltage generating device 48 supplies power to calculating circuit 62 and gap sensors 26*a*, 26*a*' to 26*d*, 26*d*', 28*a,* 28*a*' to 28*d*, 28*d*' always with a fixed voltage irrespective of fluctuations of power of power source 46 due to supply of large current to power amplifier 63 etc. As a result, calculating circuit 62 and gap sensors 26*a*, 26*a*' to 26*d*, 26*d*', 28*a*, 28*a*' to 28*d*, 28*d*' always operate normally.

Sensor unit 61 is constituted by the gap sensors 26*a*, 26*a*' to 26*d*, 26*d*', 28*a*, 28*a*' to 28*d*, 28*d*' mentioned above and current sensors 66*a*, 66*a*' to 66*d*' that detect the currents of each coil 40.

Calculating circuit 62 performs magnetic guidance control of moveable body 16 in each of the movement co-ordinate systems shown in FIG. 2. Specifically, these are the y mode (forwards/reverse movement mode) expressing forwards/reverse movement along the y co-ordinate of the center of gravity of moveable body 16, the x mode (left/right movement mode) expressing left/right movement along the x co-ordinate, the q mode (roll mode) expressing rolling about the center of gravity of moveable body 16, the ξ mode (pitch mode) expressing pitching about the center of gravity of moveable body 16, and the ψ mode (yaw mode) expressing yawing about the center of gravity of moveable body 16. In addition to these modes, guidance control is also effected in respect of the three modes relating to: the total attractive force exerted by magnetic units 30*a* to 30*d* on guide rails 14*a* and 14*b*, the torsional torque about the y axis exerted on frame 22 by magnetic units 30*a* to 30*d*, and distorting force whereby frame 22 is distorted with left/right symmetry by rolling torque applied to frame 22 by magnetic units 30*a* and 30*d* and applied to frame 22 by magnetic units 30*b* and 30*c* i.e. the ζ mode (total attraction mode), d mode (torsional mode) and g mode (distortion mode). In the above eight modes, guidance control is performed by exercising so-called zero power control so as to support the moveable body in stable fashion simply by attractive force of permanent magnets 34 irrespective of the weight of the load, by making the coil currents of magnetic units 30*a* to 30*d* converge to zero.

Calculating circuit 62 is constructed as follows in order to achieve zero power control. Specifically, it comprises: subtractors 70*a* to 70*h* that calculate the x-direction gap length deviation signals (gxa, (gxa' to (gxd, (gxd' obtained by subtracting the respective gap length set values xa0, xa0' to xd0, xd0' from the gap length signals gxa, gxa' to gxd, gxd' from the x-direction gap sensors 26*a*, 26*a*' to 26*d*, 26*d*'; subtractors 72*a* to 72*h* that calculate the y-direction gap length deviation signals (gya, (gya' to (gyd, (gyd' obtained by subtracting from the respective gap length set values ya0, ya0' to yd0, yd0' of the magnetic units 30*a* to 30*d* the gap length signals gya, gya' to gyd, gyd' from the y-direction gap sensors 28*a*, 28*a*' to 28*d*, 28*d*'; subtractors 74*a* to 74*h* that calculate the current deviation signals (ia, (ia' to (id, (id' obtained by subtracting the respective current set values ia0, ia0' to id0, id0' from the exciting current detection signals ia, ia' to id, id' from current sensors 66*a*, 66*a*' to 66*d*, 66*d*'; two average calculating circuits 76 that output the x-direction gap length deviation signals (xa to (xd and the y-direction gap length deviation signals (ya to (yd by averaging for each magnetic unit the x-direction gap length deviation signals (gxa, (gxa' to (gxd, (gxd' and y-direction gap length deviation signals (gya, (gya' to (gyd, (gyd'; levitation gap length deviation coordinate conversion circuit 81 that calculates the amount of movement (y in the y direction of the center of gravity of the movable body 16 from the gap length deviation signals (ya to (yd and the amount of movement (x in the x direction of the center of gravity of the movable body 16 from the gap length deviation signals (xa to (xd, and the angles of rotation (( of the (direction (roll direction) of the center of gravity, the angle of rotation (x of the x direction (pitch direction) of the movable body 16 and the angle of rotation (y of the y direction (yaw direction) of the movable body 16; exciting current deviation coordinates conversion circuit 83 that calculates the current deviation (iy relating to movement in the y direction of the center of gravity of movable body 16 from current deviation signals (ia, (ia' to (id, (id', the current deviation (ix relating to movement in the x direction, the current deviation (i( relating to rolling about this center of gravity, the current deviation ix relating to pitching of the movable body 16, the current deviation iψ relating to yawing about this center of gravity, and the current deviations (i(, (i(, (i( relating to (, (, ( that apply stress to the movable body 16, a control voltage calculation circuit 84 that calculates for each mode electromagnet control voltages ey, ex, e(, ex, ey, e(, e(, e( that produce stable magnetic levitation of movable body 16 in each mode of output of y, x, (, x, y, (, (, ( from (y, (x, ((, (x, (y, (iy, (ix, (i(, (ix, (iy, (i(, (i(, (i( of the levitation gap length deviation coordinates conversion circuit 81 and current deviation coordinates conversion circuit 83; and control voltage coordinate inverse conversion circuit 85 that calculates respective electromagnet exciting voltages ea, ea' to ed, ed' of the magnetic units 30*a* to 30*d* from outputs ey, ex, e(, ex, ey, e(, e(, e( of control voltage calculating circuit 84. The results of the calculation by control voltage coordinate inverse conversion circuit 85 i.e. the aforementioned ea, ea' to ed, ed' are then supplied to power amplifiers 63*a*, 63*a*' to 63*d*, 63*d*'. It should be noted that, for purposes of the subsequent description, the levitation gap length deviation coordinate conversion circuit 81, exciting current deviation coordinate conversion circuit 83, control voltage calculation circuit 84 and control voltage coordinate inverse conversion circuit 85 will be designated as levitation control calculation unit 65.

Further, control voltage calculating circuit 84 comprises: forwards/reverse movement mode control voltage calculating circuit 86*a* that calculates the electromagnet control voltage ey of the y mode from (y, (iy; left/right movement mode control voltage calculation circuit 86*b* that calculates the electromagnet control voltage ex of the x mode from (x, (ix; roll mode control voltage calculation circuit 86*c* for calculating the electromagnet control voltage e( of the (mode from ((, (i(; pitch mode control voltage calculation circuit 86*d* that calculates the electromagnet control voltage ex of the ξ mode from (x, (ix; yaw mode control voltage calculation circuit 86*e* that calculates the electromagnet control voltage ey of the y mode from (y, (iy; total attraction mode control voltage calculation circuit 88*a* that calculates the electromagnet control voltage e( of the (mode from (i(; torsional mode control voltage calculation circuit 88*b* that calculates the electromagnet control voltage e( of the (mode from (i(; and distortion mode control voltage calculation circuit 88*c* that calculates the electromagnet control voltage e( of the (mode from (i(.

Figure 7:
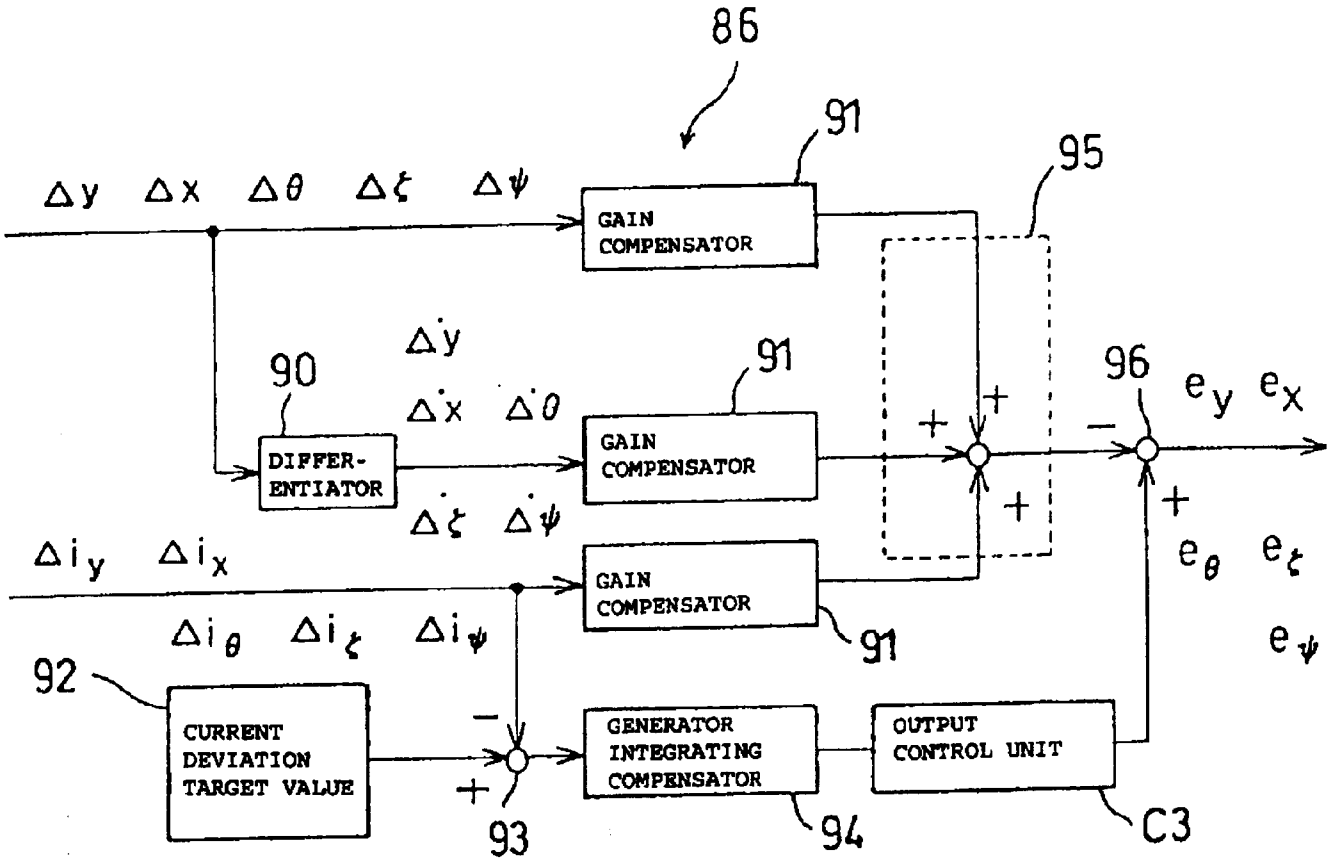
FIG. 7 is a block diagram illustrating the layout of a control voltage calculating circuit in a control device according to the first embodiment.
Figure 8:
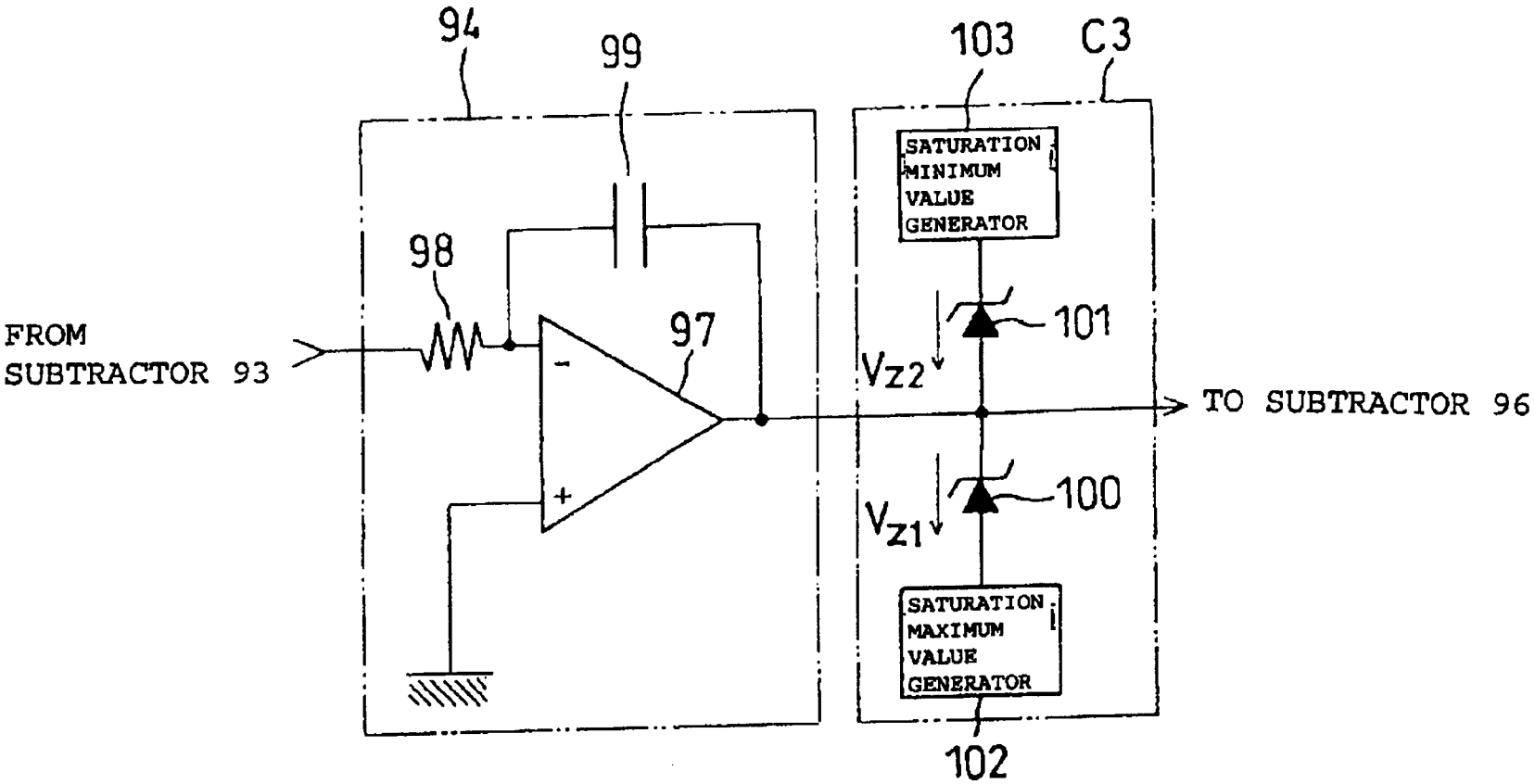
FIG. 8 is a circuit diagram illustrating the layout of output control means (unit) in a control voltage calculating circuit according to the first embodiment.

The control voltage calculation circuits of these modes comprise the construction of the guidance control means (unit) C1. Specifically, forwards/reverse movement mode control voltage calculation circuit 86*a* is constructed as shown in FIG. 7. Specifically, it comprises an differentiator 90 that calculates the time rate of change ((y of (y from (y; a gain compensator 91 that multiplies (y, ((y, and (iy by suitable feedback gains; a current deviation target value generator 92; a subtractor 93 that subtracts (iy from the target value of current deviation target value subtractor 92; an integrating compensator 34 that integrates the output value of subtractor 93 and multiplies it by a suitable feedback gain; an adder 95 that calculates the total of the output values of gain compensator 91; a subtractor 96 that outputs an electromagnet: exciting voltage ey of the y mode by subtracting the output value of adder 95 from the output value of the integrating compensator 94; and an output limiting means (unit) C3 interposed between subtractor 96 and integrating compensator 94 and that limits the output of integrating compensator 94 to a prescribed range. For example as shown in FIG. 8 integrating compensator 94 and output limiting means (unit) C3 may be constituted by an operational amplifier 97, resistance 98, capacitor 99, Zener diodes 100 and 103, saturation maximum value generator 102 and saturation minimum value generator 103. In this embodiment, if the Zener voltages of Zener diodes 100 and 101 are respectively taken as being Vz1 and Vz2 and the output voltages of the saturation maximum value generator 102 and saturation minimum value generator 101 are respectively taken as Vmax and Vmin, if the conditions: Vmax+Vz1<Vmin and Vmax+Vz1>Vmin−Vz2 and Vmax<Vmin−Vz2 are established, the output voltage Vout of the integrating compensator 94 is restricted to the range:

$$V\max+Vz1>V\text{out}>V\min-Vz2.$$

That is, if we take Vmax=−3V, Vmin=3V, Vz1=5V and Vz2=5V, the output voltage Vout of integrating compensator 94 is restricted to:

$$2\text{V}>V\text{out}>-2\text{V}.$$

Also, although switch 8 that constitutes output limiting means (unit) C3 is present on the input side of integrating compensator 4 in FIG. 1, in the embodiment relating to FIG. 8, switch 8 is not present. This is because, at the same time as switch 8 disables the operation of integrating compensator 4, the function of holding its output value in integrating compensator 4 is added. That is, in the output limiting means (unit) of FIG. 8, when the output of integrating compensator 94 (operational amplifier 97) is at the saturated value, the charge that is to be stored in capacitor 99 flows through the conductive side of Zener diode 100 or 101. As a result, the output voltage of integrating compensator 94 is always held at the saturated value. That is, the difference between FIG. 1 and FIG. 8 occurs because the function of the output limiting means (unit) C3 when integrating compensator 4 is employed in zero power control means (unit) L2 is expressed as a control block in FIG. 1; output control means (unit) C3 is of course exactly the same.

The left/right movement mode to pitch mode control voltage calculating circuits 86*b* to 86*e*, are also constructed in the same way as the forward/reverse movement mode control voltage calculating circuit 86*a*, so the corresponding input/output signals are indicated by their signal names and further description is omitted.

Figure 9:
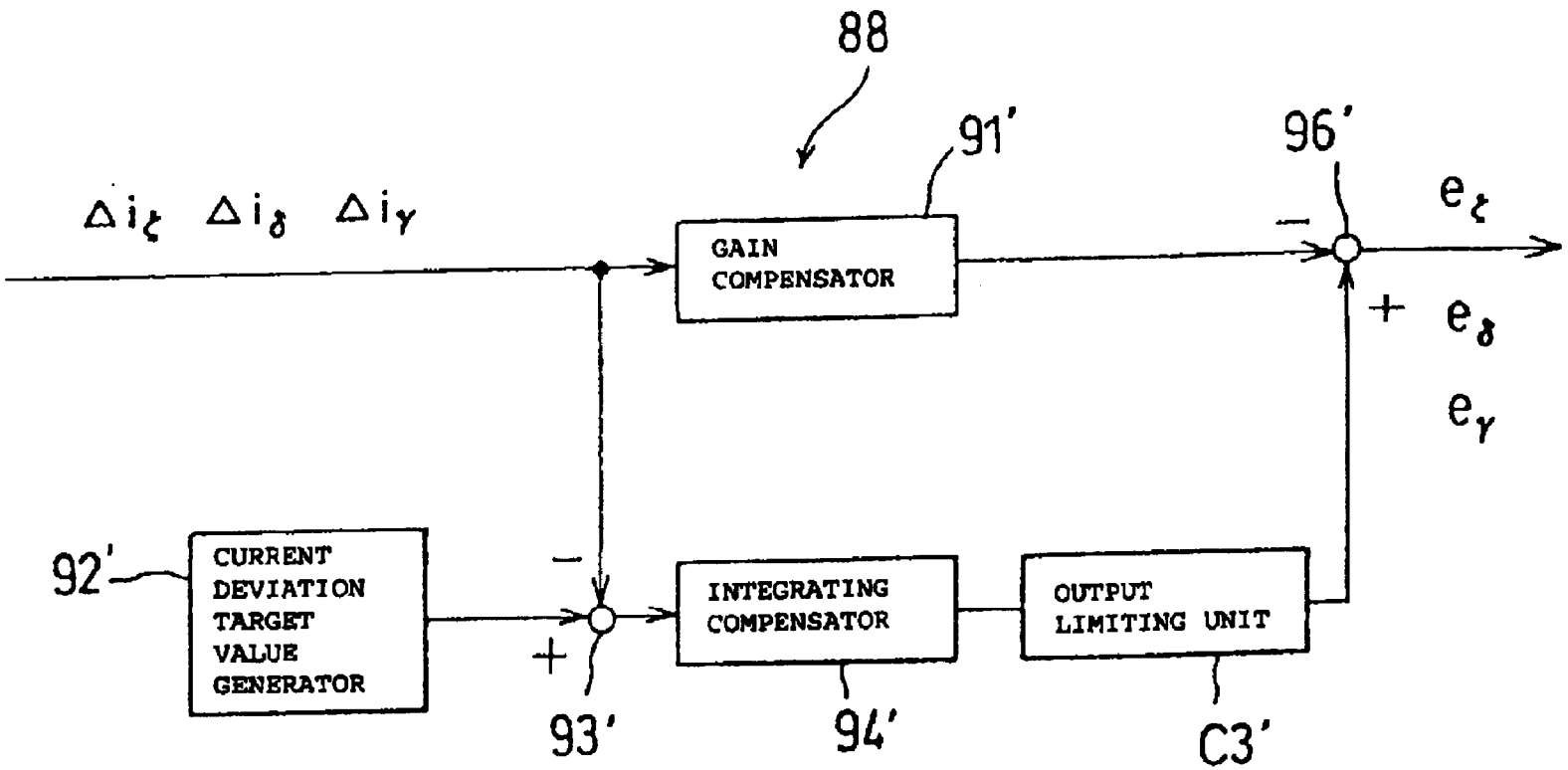
FIG. 9 is a block diagram illustrating the layout of another control voltage calculating circuit in the control device of the first embodiment.

The three respective mode control voltage calculating circuits 88*a* to 88*c* of (, ( and ( are all of the same construction, so these are denoted in FIG. 9 by giving identical portions the same reference numbers with the addition of a single quotation mark ‘ for distinguishing purposes.

Next, the operation of an elevator guidance device according to this embodiment constructed as above will be described.

Figure 5:
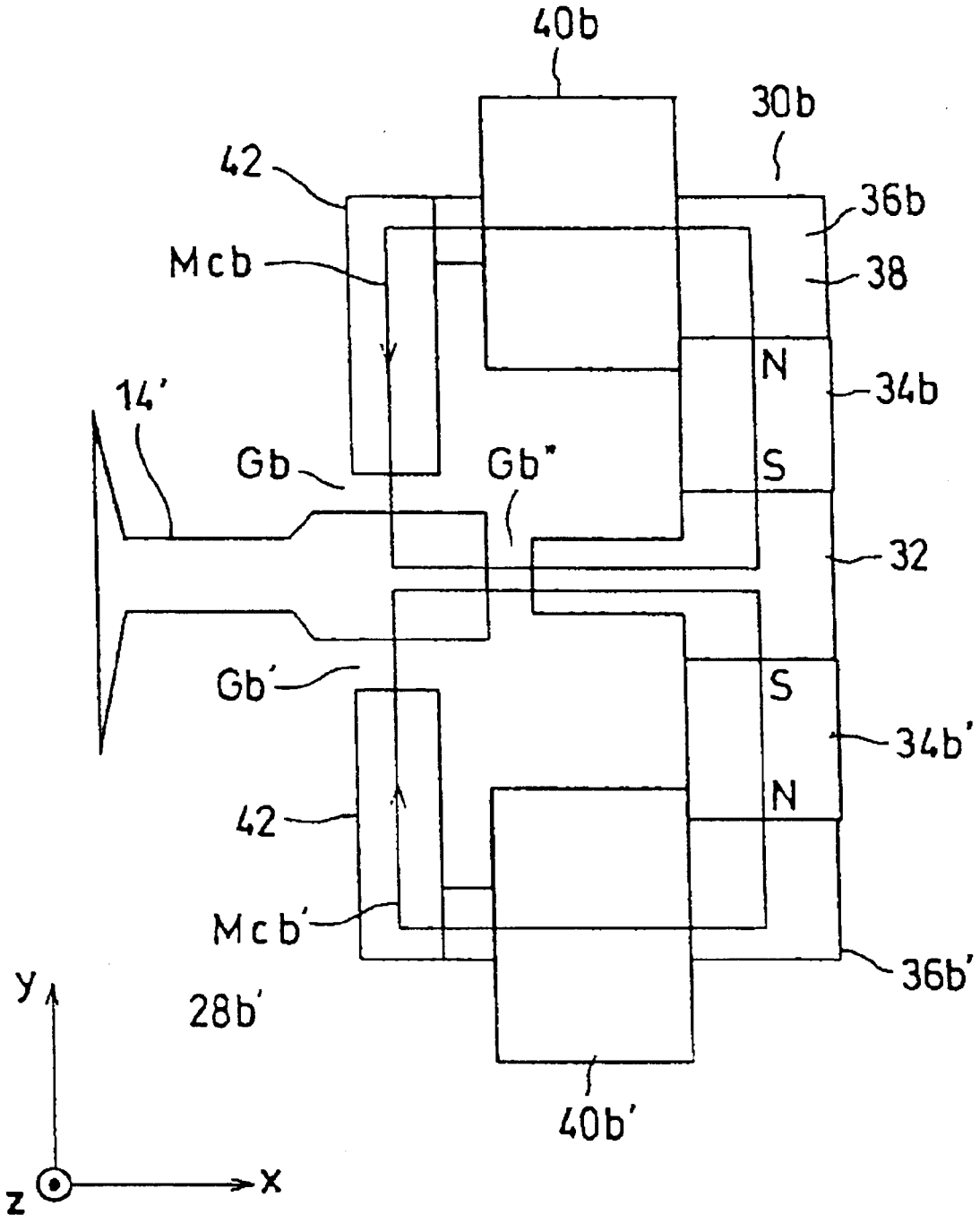
FIG. 5 is a plan view illustrating the magnetic circuit of the magnetic unit according to the first embodiment.

When the device is in the stopped condition, the tips of central iron cores 32 of magnetic units 30*a* and 30*d* adhere to the opposite faces of guide rails 14 with the solid-state lubricating members 43 therebetween, while the tips of electromagnets 36*a*' and 36*d*' adhere to the opposite faces of guide rails 14 with the solid-state lubricating members 43 therebetween, respectively. At this point, there is no obstruction to raising/lowering of moveable body 16, because of the action of lubricating members 43. In this condition, when the device is started up, thanks to the action of levitation control calculation unit 65, control device 44 generates in electromagnets 36*a*, 36*a*' to 36*d*, 36*d*' magnetic flux in the same direction or the opposite direction as the magnetic flux generated by permanent magnet 34, and controls the current flowing to coils 40 so as to maintain prescribed gap lengths between magnetic units 30*a* to 30*d* and guide rails 14 and 14'. As shown in FIG. 5, there are thereby formed a magnetic circuit Mcb comprising the paths: permanent magnet 34 to iron cores 38 and 42 to gap Gb to guide rails 14 (14') to gap G" to central iron core 32 to permanent magnet 34 and magnetic circuit Mcb' comprising the paths: permanent magnet 34' to iron cores 38 and 42 to gap Gb' to guide rails 14 (14') to gap Gb" to central iron core 32 to permanent magnet 34. The gap lengths in gaps Gb, Gb', Gb" become lengths at which the magnetic attractive force of magnetic units 30*a* to 30*d* produced by the magnetomotive force of permanent magnet 34 exactly balances the forwards/reverse force in the y-direction acting on the center of gravity of moveable body 16, the left/right force in the x-direction acting thereon, the torque about the x axis passing through the center of gravity of moveable body 16, the torque about the y axis passing therethrough, and the torque about the z axis passing therethrough. Control device 44 performs exciting current control of electromagnets 36*a*, 36*a*' to 36*d*, 36*d*' when the external force of moveable body 16 acts so as to maintain this balance. In this way, so-called zero power control is performed.

Now, when raising/lowering of moveable body 16 which is guided in non-contacting manner under zero power control along the guide rails is commenced by a winding mechanism (that is, hoist machine), constituting a moving force conferring means (unit), not shown and shaking of the moveable body is produced due to for example curvature of the guide rails, since the magnetic units are provided with permanent magnets sharing the magnetic path in the gap with the electromagnets, the shaking can be suppressed by rapidly controlling the attractive force of the magnetic units by excitation of the electromagnet coils. Also, by the choice of a permanent magnet of large residual magnetic flux density and coercive force, there is no adverse effect on control capability of the non-contacting guidance control even though the gap lengths are large, so guidance control of low rigidity with a large stroke can be achieved even though shaking occurs within the moveable body 16 due for example to movement of the passengers, and riding comfort is therefore unimpaired. Furthermore, thanks to the arrangement of magnetic units whose poles face each other with the guide rails in between, some or all of the attractive force with which the opposing magnetic poles act on the guide rails is cancelled out, so there is no possibility of a large attractive force acting on the guide rails. Consequently, there is no possibility of a large attractive force of the magnetic units acting from one direction, so there is also no possibility of the installed positions of the guide rails being displaced or for example occurrence of a step at joint 98 or deterioration of linearity of the guide rails. As a result, the installation strength of the guide rails can be lowered, making it possible to reduce the costs of the elevator system.

Also, if excessive external force acts on moveable body 16 for some reason such as a one-sided movement of personnel or load, or shaking of the rope caused by an earthquake etc, variation of the gap lengths between magnetic units 30*a* to 30*d* and guide rails 14 and 14' may occur. This variation is in the opposite direction to the direction of application of external force at the magnetic poles that generate attractive force opposing the external force, and so tries to produce contact between the magnetic units 30*a* to 30*d* and guide rails 14 and 14'. When this happens, the output of zero power control means (unit) L2 exceeds the prescribed value, so its operation is disabled and its output value is held and a seamless shift of guidance control from zero power control to gap length control takes place. As a result, the gap length, which had originally changed in the direction opposite to the external force under the influence of the external force, now changes in the direction of the external force when the zero power control function is disabled. Although, if the external force is excessive, even though the direction of variation of the gap length is reversed, the magnetic units and the guide rails would ultimately come into contact, if the output limiting means (unit) of the present invention were not provided, the operation of the zero power control would not be disabled, so contact with the guide rails would occur with a smaller external force. Consequently, with the output limiting means (unit) of the present invention, reliability of the device is improved whilst maintaining a comfortable ride.

When, on completion of movement of this device, the device is stopped, in current deviation target value generator 92 in the y mode and x mode, the target value is gradually changed from zero to a negative value and moveable body 16 is gradually moved in the direction of the y axis or x axis until finally the tips of the central iron cores 32 of magnetic units 30*a* and 30*d* respectively adhere to the opposite face of guide rail 14 with solid-state lubricating members 43 therebetween and the tips of electromagnets 36*a*' and 36*d*' likewise adhere to the opposite faces of guide rails 14 with solid-state lubricating members 43 therebetween. When, in this condition, the device is stopped, the current deviation target value is reset to zero and the moveable body adheres to the guide rails.

It should be noted that, although in the first embodiment described above an E-shaped magnetic unit was employed for the guidance units, this in no way restricts the construction of the magnetic units, which could be altered in various ways. For example, a magnetic unit could be constructed in which adjacent poles of a pair of U-shaped magnets constituting the permanent magnet and electromagnets are made to face each other and some of the magnetic poles are made to face the guide rails. Also, although guide rails of I-shaped axial cross-sectional shape were employed as the guide rails, these do not restrict the shape of the guide rails in any way and for example they could be circular, elliptical, or box-shaped.

Next, a second embodiment of the present invention will be described with reference to FIG. 10 and FIG. 11.

Figure 10:
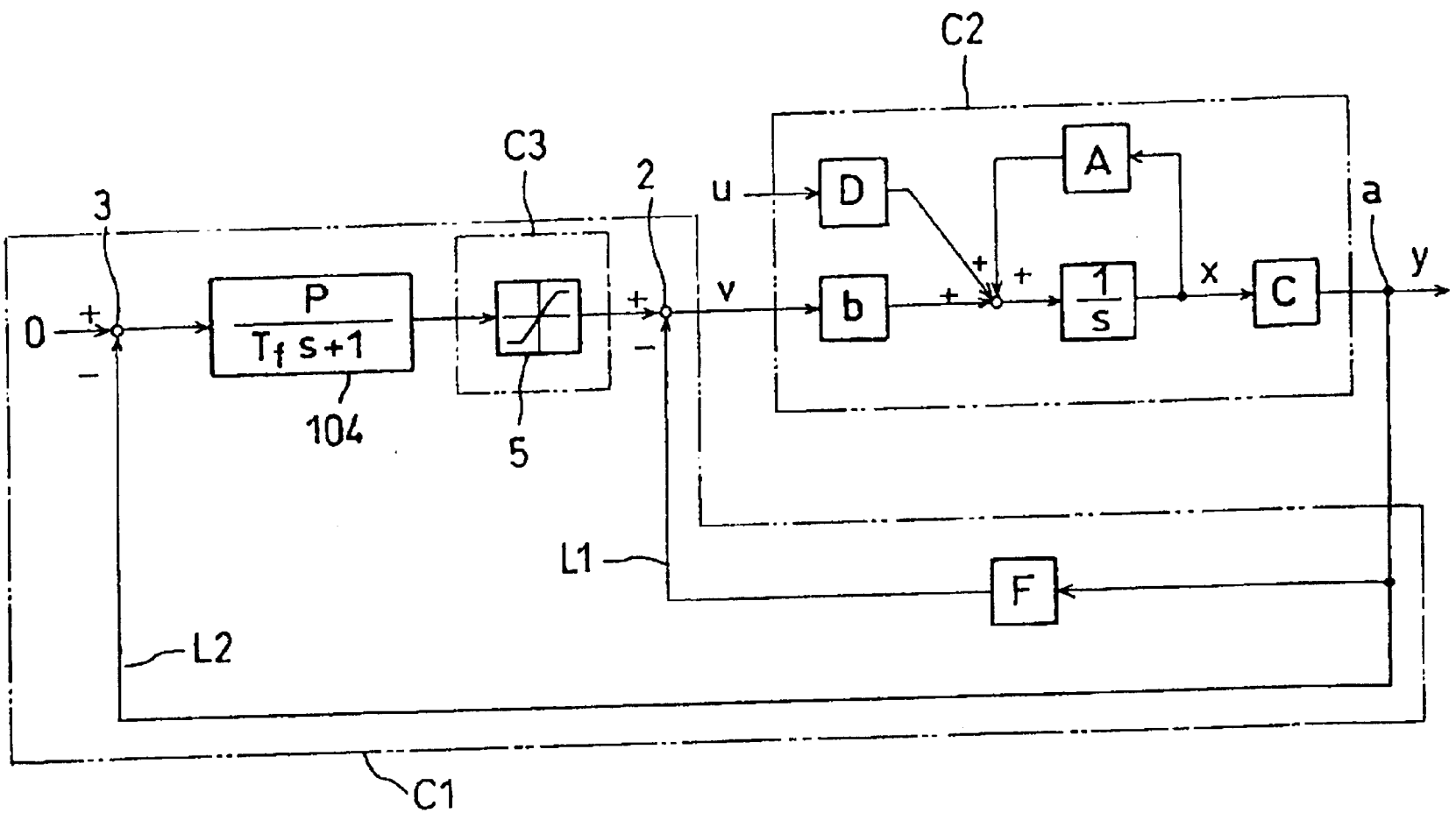
FIG. 10 is a block diagram illustrating the overall construction of a second embodiment.
Figure 11:
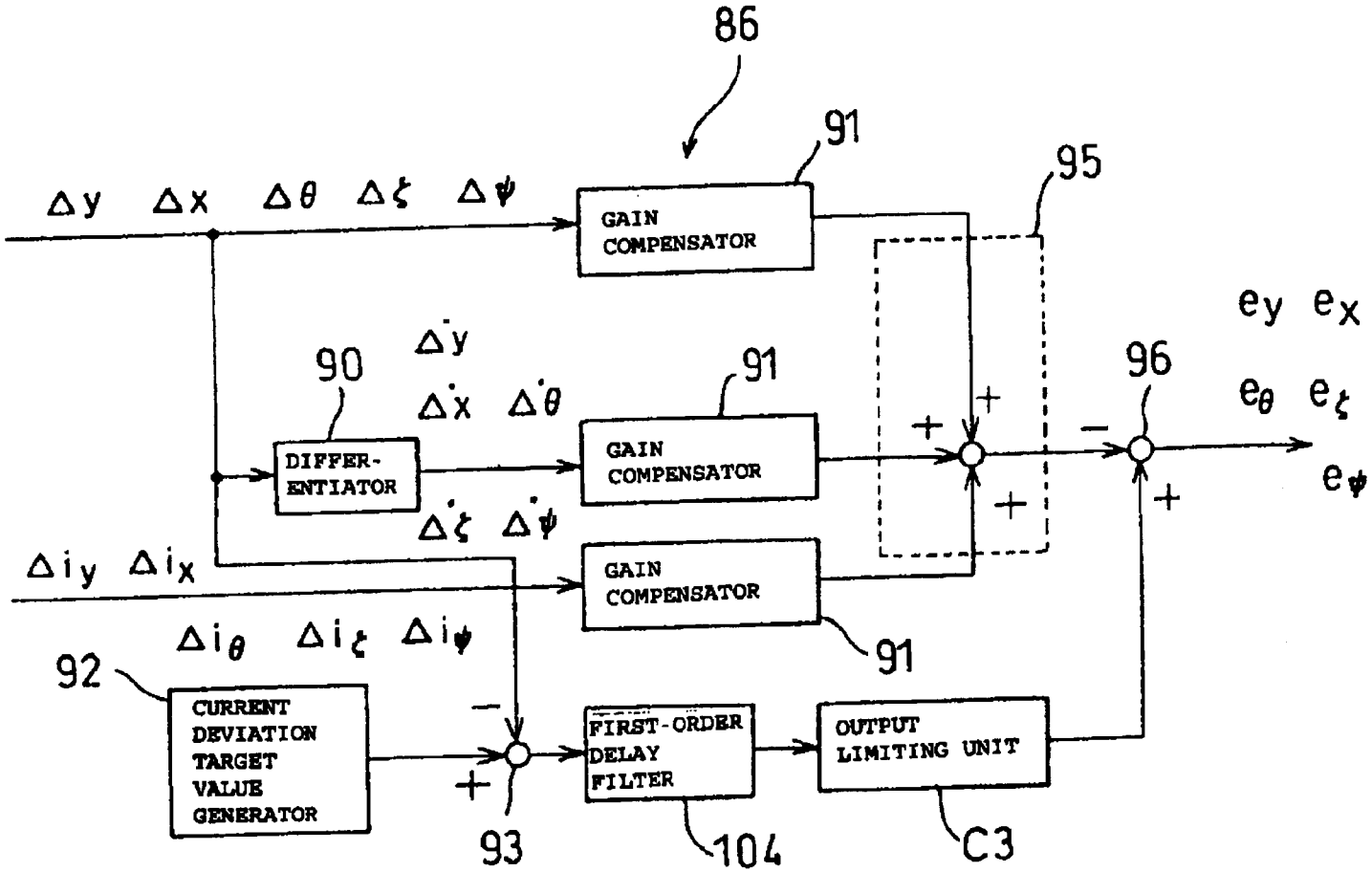
FIG. 11 is a block diagram illustrating the layout of a control voltage calculating circuit in a control device according to the second embodiment.

Although, in the first embodiment, in the zero power control means (unit) L2, integrating compensators 4 and 94 were employed that integrate the coil exciting current values, these do not restrict the construction of the zero power control means (unit) in any way and, as shown in FIG. 10 and FIG. 11, this could be constructed using a first-order delay filter 104. In order to simplify the description, hereinbelow, parts that are common with the first embodiment will be described using the same reference symbols.

Zero power control means (unit) 62 comprises a zero power feedback loop from point a to subtractor 3 to first-order delay filter 104 to subtractor 2. If the time constant of the first-order delay filter 104 is assumed to be Tf and the values of the gain compensator 91 respectively relating to displacement, speed, and exciting current in each control mode are assumed to be F1, F2 and F3, zero power control can be achieved by making the gain P of this first-order delay filter 104 for example P=[−F1 0 0]. Since if the feedback gain F1 of the gain compensator with respect to displacement is already known, zero power control by this zero power control means (unit) can be achieved, this zero power control means (unit) has the advantage that detection of the exciting current can be dispensed with.

Figure 12:
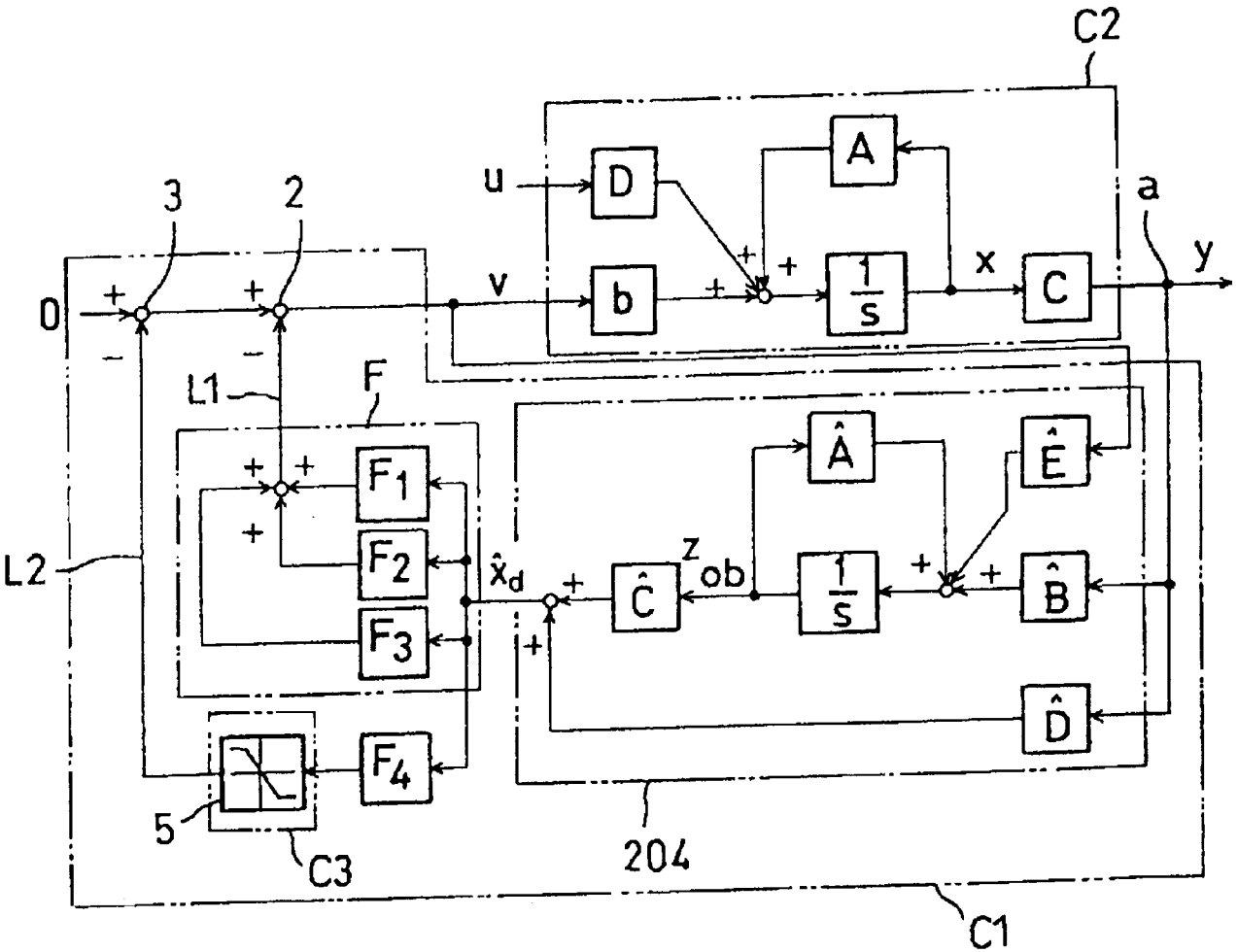
FIG. 12 is a block diagram illustrating the overall construction of a third embodiment.
Figure 13:
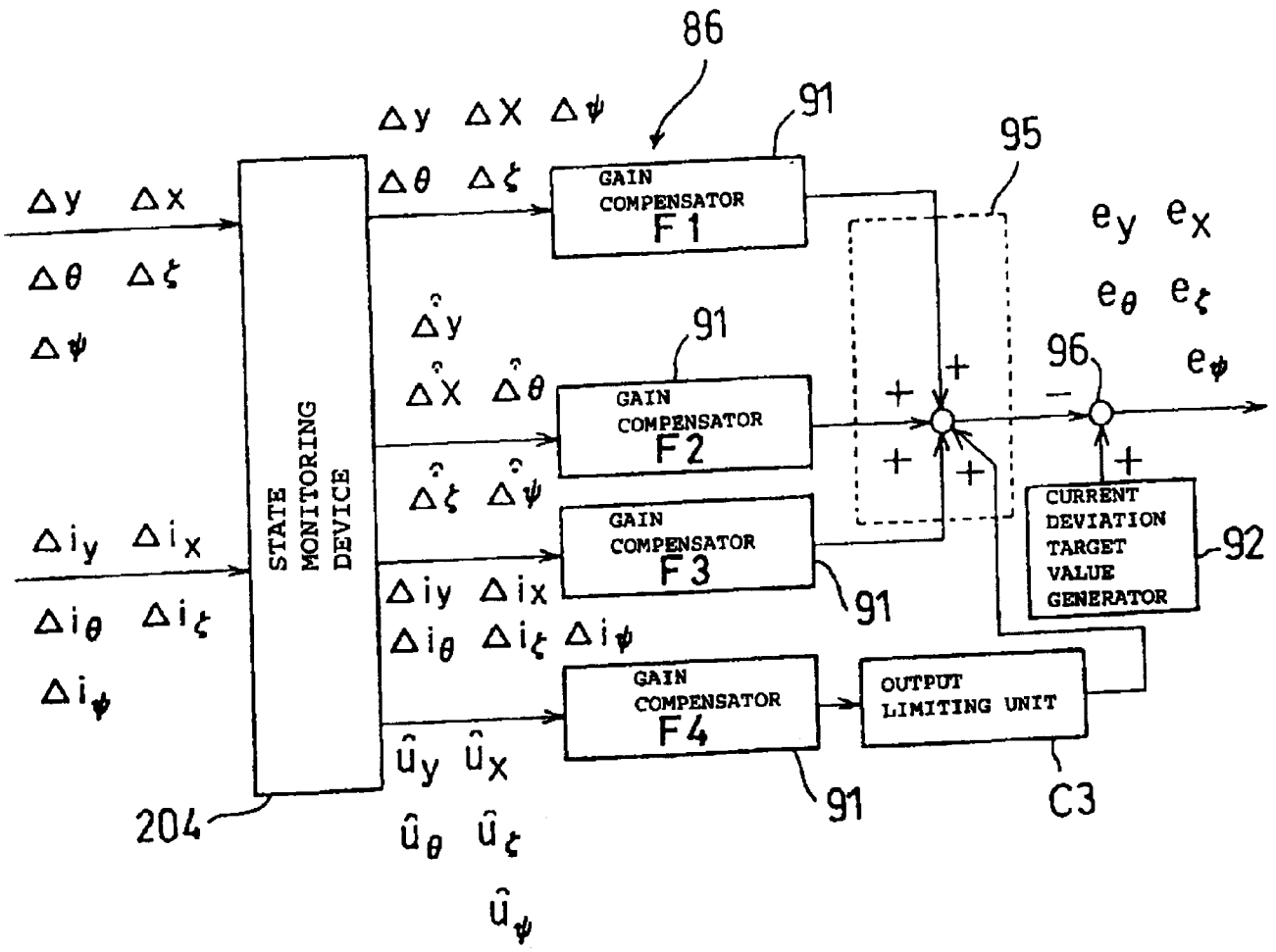
FIG. 13 is a block diagram illustrating the layout of a control voltage calculating circuit in a control device according to the third embodiment.

Also, a third embodiment of the present invention is described with reference to FIG. 12 and FIG. 13. Although, in the first and second embodiments described above, the zero power control means (unit) L2 was equipped with an integrating compensator or first-order delay filter, it could be constituted using a state monitoring device 204 as shown in FIG. 12 and FIG. 13. State monitoring device 204 constitutes a zero power control means (unit) L2 through subtractor 3 to subtractor 2 wherein the speed in each mode and the external force that is applied to moveable body 16 are inferred from the displacement in each mode and the exciting current values, and the inferred value of the external force, multiplied by F4, is taken as the feedback signal for zero power control. Also, although, in the first and second embodiments, the speed was obtained by differentiating the displacement by differentiator 90, with the zero power control means (unit) in this case, both an inferred value of the external force and inferred value of the speed are obtained by the state monitoring device 204, so the characteristic advantage is achieved that a speed signal of excellent S/N ratio is obtained. In FIG. 12 and FIG. 13, the symbol ^ indicates an inferred value.

Figure 14:
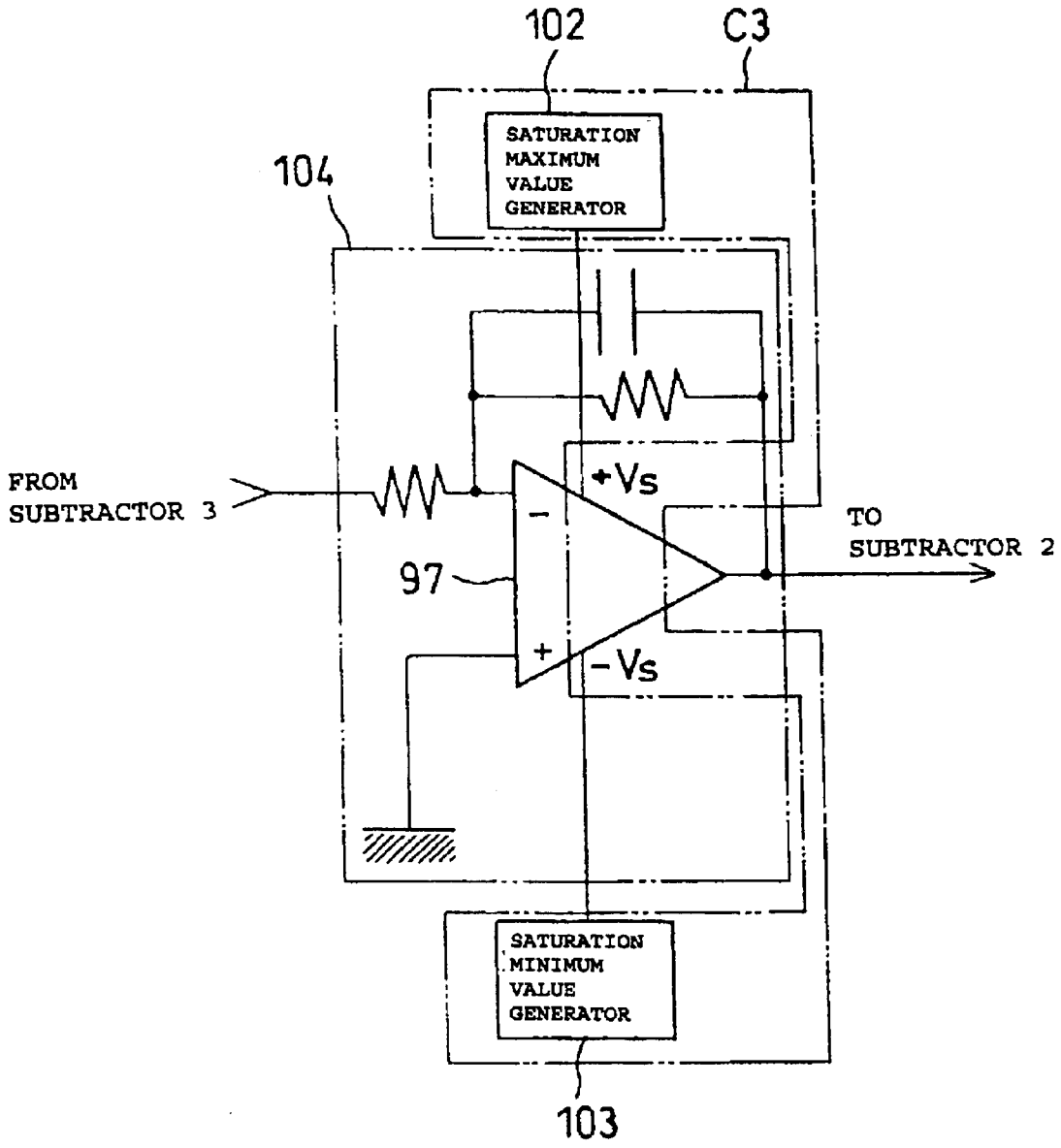
FIG. 14 is a circuit diagram illustrating the layout of output control means (unit) in a control voltage calculating circuit according to a fourth embodiment of the present invention.

A fourth embodiment of the present invention will now be described with reference to FIG. 14. Although, in the first embodiment, output limiting means (unit) C3 was constituted using the Zener diodes 100 and 101, this does not restrict the construction of the output limiting means (unit) in any way and, as shown in FIG. 14, it could be constructed by connecting a saturation maximum value generator 102 to the positive side power source pin +Vs of operational amplifier 97 and a saturation minimum value generator 103 to the negative side power source pin −Vs. In this embodiment, the case is shown where an output limiting means (unit) C3 is added to the first-order delay filter 104 according to the second embodiment of the present invention of zero power control means (unit) L2. First-order delay filter 104 is constituted in this case by operational amplifier 97, resistance 198 and capacitor 199. This embodiment has the advantage of an extremely straightforward construction. As described above, so long as this output limiting means (unit) C3 has the function of limiting the output of the zero power control means (unit) L2, it may be of any construction.

Furthermore, although, in the embodiments described above, the condition of the gap portion of the magnetic circuit formed by the magnetic units and guide rails was detected by measurement of the gap length by the average of two gap sensors in which the electromagnet excitation current is detected by a current sensor, this does not restrict the method of measurement of the gap length or the use of the gap sensors or the use of the current sensors in any way; any method may be employed so long as it makes possible detection of the condition of the gap portion of the magnetic circuit formed by the magnetic units and the guide rails.

In addition, although, in the above embodiments, the calculation circuit that performs zero power control was described in terms of analogue control, this does not restrict the control system to analogue or digital in any way and digital control could also be applied in the calculating circuit.

Also, although, in the above embodiments, voltage type power amplifiers were employed, this does not restrict the type of the power amplifiers in any way and current type or PWM type power amplifiers could be used.

Apart from this, various modifications may be made without departing from the scope of the present invention.

As described above, with an elevator guidance device according to the present invention, thanks to the provision of output limiting means (unit) that limit the output of the zero power control means (unit) in accordance with the output value of itself, a comfortable ride can always be obtained by avoiding vibration of the elevator cage caused by actuation/disabling of the zero power control means (unit) and wherein variation of the output value of the zero power control means (unit) is continuous and smooth, irrespective of variations of the gap length resulting from external force. Also, even if, due to excessive external force, operation of the zero power control means (unit) is disabled but the magnetic units still come into contact with the guide rails, once this external force is removed, the elevator cage can again be restored to a non-contacting condition, so there is no possibility of the magnetic units remaining adhering to the guide rails; consequently, there is no need to deal with application of external force by making the magnetic units of large size or by making the design value of the gap length small, so the cost of the elevator system can be lowered.

Also, a device can be provided which is of high reliability whilst maintaining a comfortable ride, since the width of variation of the gap length before the magnetic units come into contact with the guide rails can be increased by a maximum factor of 2, because the gap length, which previously varied in the direction opposing the external force on initial application of the external force, now varies in the direction of the external force, when the function of the zero power control means (unit) is disabled by the output limiting means (unit).

Obviously, numerous additional modifications and variations of the present invention are possible in light of the above teachings. It is therefore to be understood that within the scope of the appended claims, the present invention may be practiced otherwise than as specially described herein.

What is claimed is:

1. An elevator guidance device, comprising:

a guide rail installed in a vertical direction;

a moveable body capable of being raised and lowered along said guide rail;

an electromagnet mounted on said moveable body and including a plurality of magnetic poles that face said guide rails with a gap therebetween and which is arranged so that attractive forces that act on said guide rails at at least two of said plurality of magnetic poles are in mutually opposite directions;

a plurality of magnetic units including a permanent magnet that supplies magnetomotive force needed for guidance of said moveable body and that is arranged so as to share a magnetic path with said electromagnets in said gap;

sensors configured to detect a condition in said gap of a magnetic circuit formed by said electromagnets with said gap and said guide rail;

a guidance control unit controlling an exciting current of said electromagnets in accordance with the output of said sensors and thereby stabilizing said magnetic circuits;

a zero power control unit stabilizing said magnetic circuits in a condition wherein an exciting current of said electromagnets is zero, based on an output of said sensors; and an output limiting unit setting a prescribed saturation value for an output of said zero power control unit and if said output of said zero power control unit exceeds a range defined by said saturation value, and making said saturation value said output of said zero power control unit.

2. The elevator guidance device according to claim 1, wherein said zero power control unit comprises an integrator that integrates deviations of said exciting current from a prescribed value, with a prescribed gain.

3. The elevator guidance device according to claim 1, wherein said zero power control unit comprises a state monitoring device that monitors an external force that is applied to an magnetic guidance system from an output value of said sensors and a gain compensator that multiplies by a prescribed gain an inferred value of said external force monitored by said state monitoring device.

4. The elevator guidance device according to claim 1, wherein said zero power control unit comprises at least a first-order delay filter that inputs an output of said sensors.

5. The elevator guidance device according to claim 1, wherein said out limiting unit has a function whereby said output limiting unit, if an output value of said zero power control unit is outside a range specified by a prescribed maximum saturation value and minimum saturation value, if said output value of said zero power control unit is larger than said maximum saturation value, outputs said maximum saturation value and if said output value of said zero power control is smaller than said minimum saturation value, outputs said minimum saturation value and if said output value of said zero power control unit is within a range, outputs said output value of said zero power control unit unchanged.

6. The elevator guidance device according to claim 1, wherein said output limiting unit comprises a Zener diode arranged with an output terminal of said zero power control unit in a forward direction from an output terminal of a constant-voltage source that defines said maximum saturation value.

7. The elevator guidance device according to claim 1, wherein said output limiting unit comprises a Zener diode arranged with an output terminal of a constant-voltage source that defines said minimum saturation value in a forward direction from an output terminal of said zero power control unit.

8. The elevator guidance device according to claim 5, wherein said output limiting unit comprises a first Zener diode arranged with an output terminal of said zero power control unit in a forward direction from an output terminal of a constant-voltage source that defines said maximum saturation value and a second Zener diode arranged with an output terminal of a constant-voltage source that defines said minimum saturation value in a forward direction from an output terminal of said zero power control unit.

9. The elevator guidance device according to claim 5, wherein said output limiting unit comprises an operational amplifier whose positive side power source is a fixed voltage source that defines said maximum saturation value and whose negative side power source is a fixed voltage source that defines said minimum saturation value.

* * * * *